United States Patent [19]

Matsui et al.

[11] 4,266,760

[45] May 12, 1981

[54] DEVICE FOR CONTROLLING TILTING OF HEADREST OF TREATMENT TABLE

[75] Inventors: Takahiro Matsui, Uji; Yoshio Saito, Kyoto, both of Japan

[73] Assignee: Kabushiki Kaisha Morita Seisakusho, Kyoto, Japan

[21] Appl. No.: 121,500

[22] Filed: Feb. 14, 1980

[30] Foreign Application Priority Data

Feb. 14, 1979 [JP] Japan ..... 54-18386[U]

[51] Int. Cl.[3] ..... A47C 1/10

[52] U.S. Cl. ..... 269/323; 269/328; 297/408

[58] Field of Search ..... 5/434, 437; 297/408, 297/371; 269/328, 323-326

[56] References Cited

U.S. PATENT DOCUMENTS

| | | | |
|---|---|---|---|
| 3,603,642 | 9/1971 | Laessker | 297/408 |
| 3,936,091 | 2/1976 | Rabinowitz | 297/408 X |

*Primary Examiner*—Robert C. Watson

*Attorney, Agent, or Firm*—Koda and Androlia

[57] ABSTRACT

This disclosure relates to a device for controlling tilting of headrest of treatment table such as for treating the teeth, eyes, nose and the like. The device makes it possible for an operator to tilt the headrest efficiently by such very simple manipulation as to enable backward and rearward tilting of the headrest by pushing in a support shaft in one direction which is transversely incorporated into a headrest carrier or a backrest carrier and to retain the headrest in a desired position by releasing the pushing force of the support shaft in the position.

4 Claims, 6 Drawing Figures

DEVICE FOR CONTROLLING TILTING OF HEADREST OF TREATMENT TABLE

BACKGROUND OF THE INVENTION

1. Field of the Invention

This invention relates to a device for controlling tilting of a headrest in a treatment table such as for treatment of the teeth, eyes, ears, nose and the like, and more particularly to a device which is very easy for a user to operate and permits the efficient tilting of the headrest in such a manner as to enable backward and rearward tilting of the headrest by pushing in a support shaft in one direction which is transversely incorporated into a headrest base or a backrest base and to retain the headrest in a desired position by releasing the pushing force of the supporting shaft in the desired position.

2. Prior Art

Devices for controlling tilting of a headrest in a treatment table have heretofore been proposed in various types. For example, Japanese Utility Model Publication No. 3,193/70 filed previously by the present applicant or Japanese Utility Model Application No. 34,079/78 filed by another company are mentioned as a case in point, and the problem pointed out in common with the cited references is that parts incorporated as a means for tilting a headrest back and forth with respect to the backrest are relatively large in number and that no locking works when the backrest is tilted forward, namely, because the backrest is in the state of its being released from locking, a patient may be forced to bend down forward depending upon the posture in which he is treated. For example, in eye treatment, when a physician seated behind the backrest is treating the patient lying on the headrest and backrest inclined backward and if the physician happens to strike his knee against the headrest to thereby incline the headrest forward, the patient is caused to be subjected to a pain in his head due to deflection on the head and the physician also misses his aim. To mention other minor shortcomings, because a segmented rack is used in the prior art as one of the locking means, the pitch of teeth is relatively large and hence it is difficult to make fine adjustment of tilting. This invention is directed to improvements in the point mentioned above.

SUMMARY OF THE INVENTION

Accordingly, it is a general object of the present invention to provide a device for controlling the tilting of a headrest for a treatment table which is simple and easy to operate.

In keeping with the principles of the present invention, the objects are accomplished by a unique device for controlling tilting of headrest of treatment table such as for treating the teeth, eyes, nose and the like. The device makes it possible for an operator to tilt the headrest efficiently by such very simple manipulation as to enable backward and rearward tilting of the headrest by pushing in a support shaft in one direction which is transversely incorporated into a headrest carrier or a backrest carrier and to retain the headrest in a desired position by releasing the pushing force of the support shaft in the position.

DETAILED DESCRIPTION OF THE INVENTION

Figure 1:
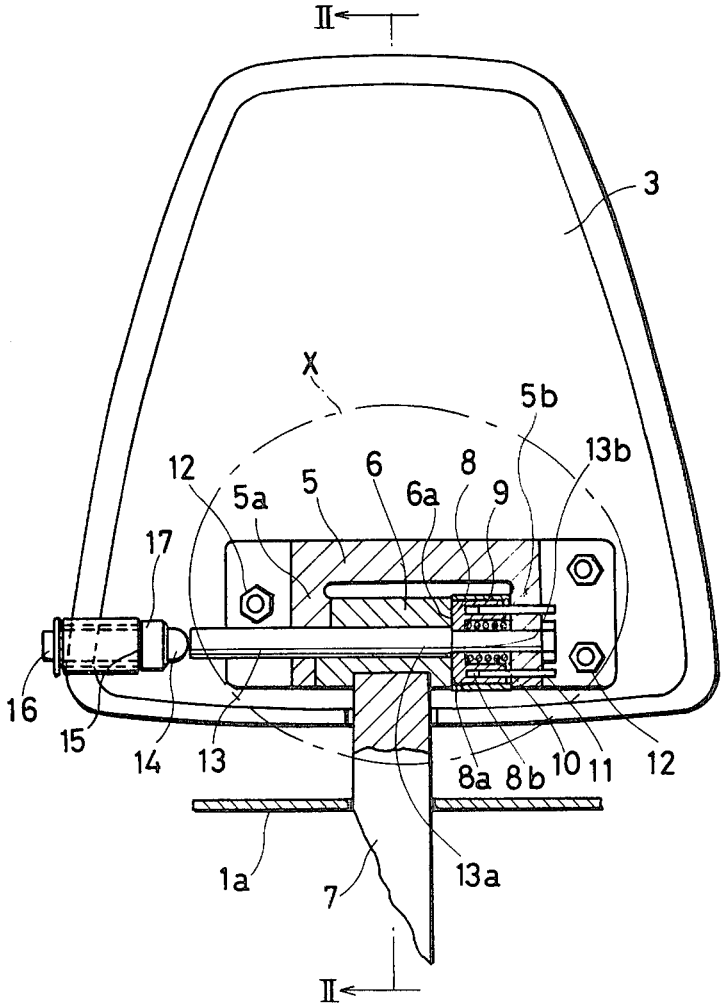
FIG. 1 is a sectional front view, broken in part, of one embodiment of the device according to the invention, with the headrest detached from the device.
Figure 2:
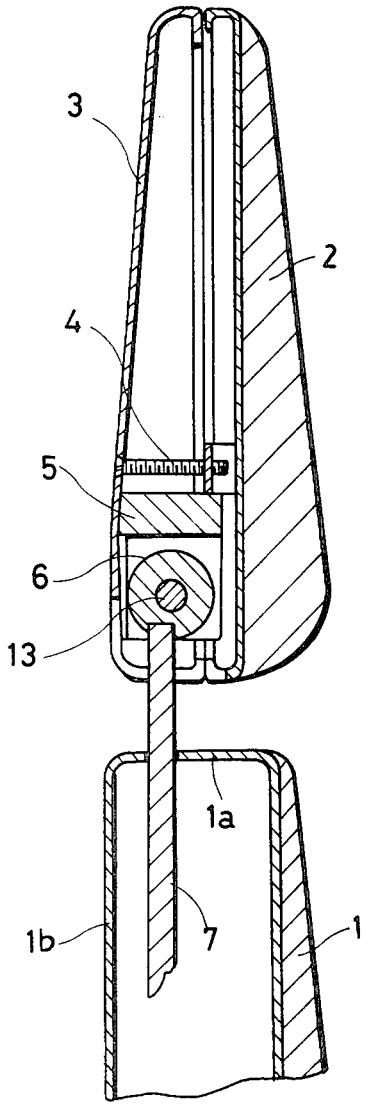
FIG. 2 is a sectional view taken along the line II—II of FIG. 1.
Figure 3:
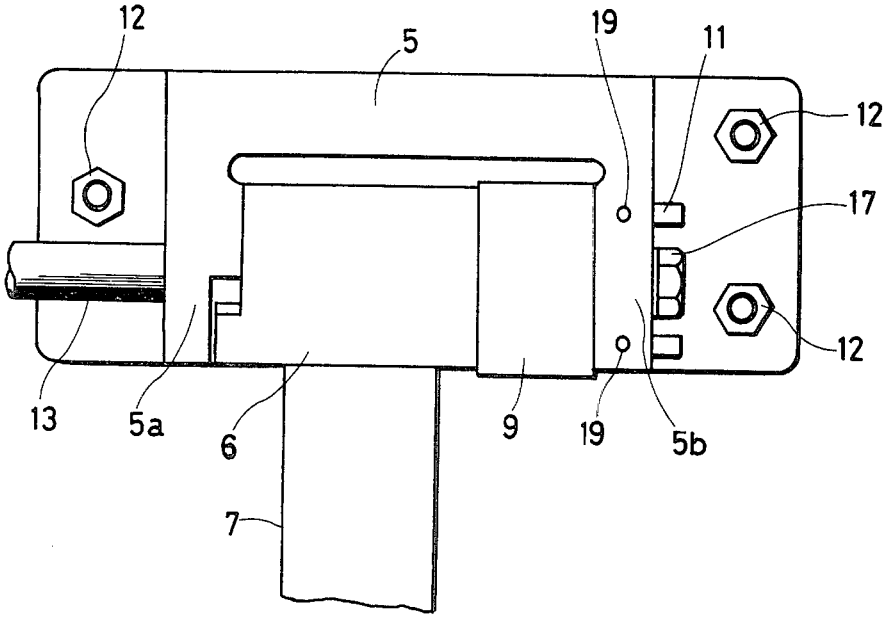
FIG. 3 is an enlarged plan view of the portion X of FIG. 1.
Figure 4:
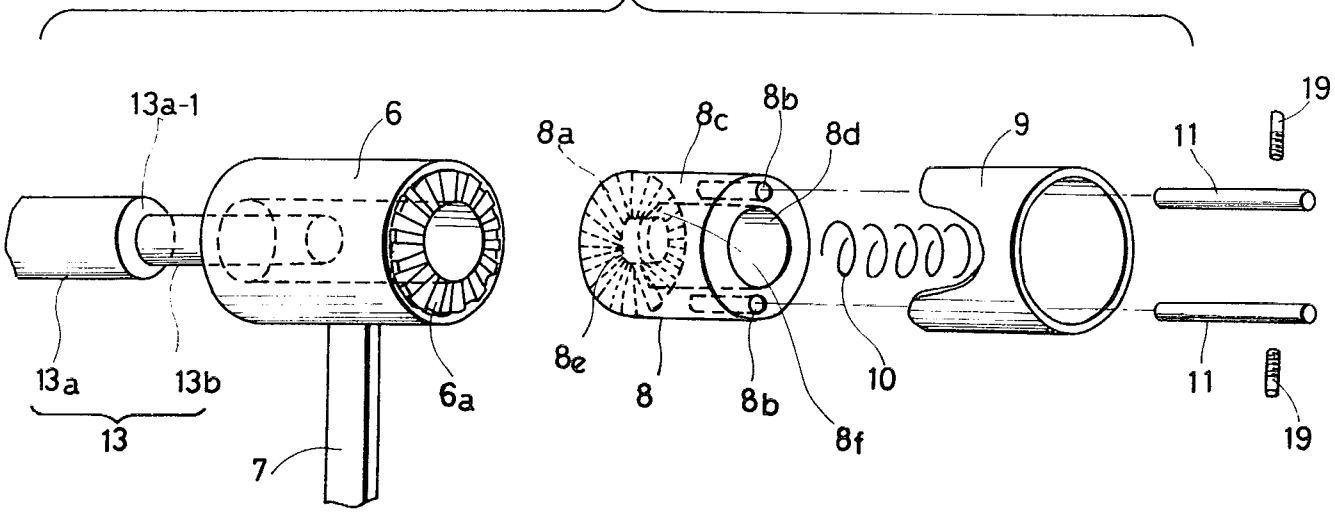
FIG. 4 is an exploded view of the essential part of the device.
Figure 5:
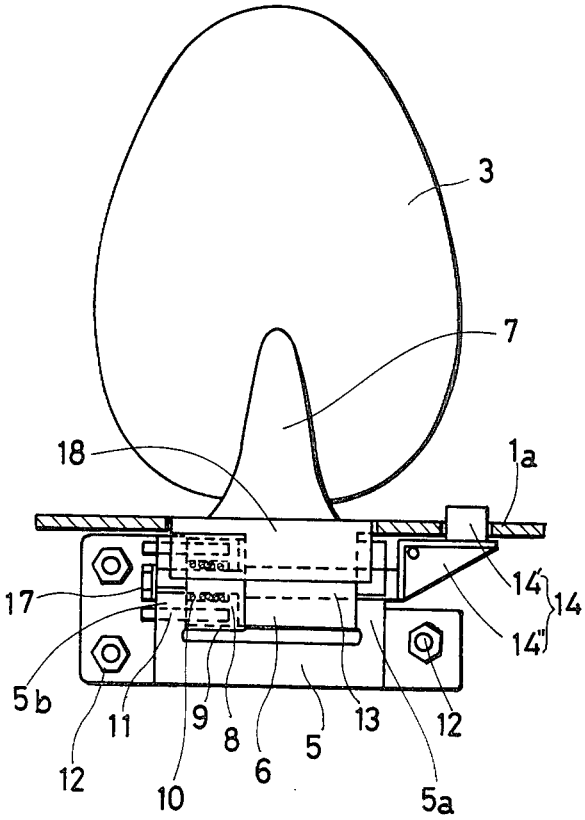
FIG. 5 is a sectional front view, broken in part, of another embodiment of the device according to the invention with the backrest detached from the device.
Figure 6:
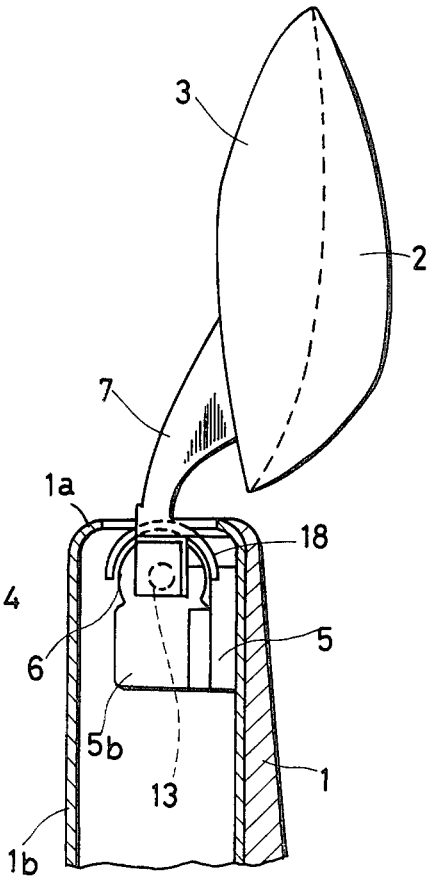
FIG. 6 is a segmentary sectional side view of FIG. 5 but with the backrest attached.

A detailed description will now be given to this invention with reference to the preferred embodiments of the invention in conjunction with the accompanying drawings, wherein FIG. 1 is a sectional front view, broken in part, of one embodiment of the device according to the invention, with the headrest detached from the device; FIG. 2 is a sectional view (including the headrest) taken along the line II—II of FIG. 1; FIG. 3 is an enlarged plane view of portion X of FIG. 1; FIG. 4 is an exploded view of the essential part of the device; FIG. 5 is a front elevation, broken in part, of another embodiment of the device; and FIG. 6 is a segmentary sectional side view of FIG. 5 (but with the backrest attached).

The difference between the two embodiments is that in one embodiment a transverse support 13 which supports forward and rearward tilting of the headrest and which supports a rotary bearing 6 that becomes a medium for locking the headrest in position is provided on the headrest 2 side (inside a headrest carrier 3), while in the other embodiment a support shaft 13 is provided on the backrest 1 side (inside a backrest carrier 1*b*). The mechanism for rotating and stopping the bearing 6 is the same in the two embodiments.

In one embodiment shown in FIGS. 1 through 4, the numeral 1 designates a backrest base of a treatment table; 1*a* an upper end plate of the backrest; 1*b* a backrest carrier; and 2 designates a headrest fastened by screws 4 to a headrest carrier 3. The numeral 5 designates a support base fixed by screws 12 to the headrest carrier and 6 designates a rotary bearing which is an important member in the invention. In this embodiment, the bearing 6 is shown as a cylindrical hollow body welded to the upper end of a support 7. The rotary bearing 6 is rotatably inserted around a transverse support shaft 13 and is axially locked against movement by journal portions 5*a* and 5*b* (through collars 9 to be later described) provided in the support base 5 and is formed on one side end face (on the right side end face in FIGS. 2, 3 and 4) with radial trapezoidal pawl teeth 6*a*. The numeral 8 designates a ratchet wheel of a U-shaped cross-section corresponding to the rotary bearing 6, the wheel being inserted around the shaft 13 movably with respect to the axial direction of the shaft 13 and being provided with radially arranged trapezoidal pawl teeth 8*a* corresponding to the teeth 6*a* of the bearing 6 and being also provided on the end face of a ring drum 8*c* with several pin holes 8*b* in parallel to the axis of the drum. Furthermore, a compression spring (coil spring) 10 for maintaining the teeth 6*a* and 8*a* normally in mating relation with each other is inserted into a cavity 8*d* and compressed between the front wall 8*f* of the cavity 8*d* and a journal portion 5*b* of a support base 15. A support shaft 13 is slidably journaled respectively on the journal portion 5*a* of the support base 5 on the left side in FIGS. 2 and 3 and on the journal portion 5*b* of the support base 5 on the right side, and the enlarged diameter portion 13*a* and reduced diameter portion 13*b* are inserted respectively into the bearing 6 and into a ratchet wheel 8 and the journal portion 5*b*, and in the state of the pawl teeth 6*a* and 8*a* being shown brought into engagement with each other in FIGS. 2 and 3, an offset diameter portion 13*a*-1 of the enlarged diameter portion 13*a* is brought into abutment against the side circumferential wall 8*e* of axial bore of the ratchet wheel 8.

Pins 11 for preventing circumferential rotation of the ratchet wheel 8 are loosely inserted into the pin holes 8*b*, the pins being fixed by screws 19 to the journal portion 5*b*. One end (right end) of the reduced diameter portion 13*b* of the support shaft 3 passes through the journal portion 5*b* and is provided with a thread (not shown) over which a nut 17 is fitted so as to fix the one end to the journal portion 5*b* to prevent the support shaft 3 from moving out of place to the left in the drawing. There is also provided a collar 9 which is sleeved over the outer periphery of the ratchet wheel 8, the collar being abutting at one end against the end face of the rotary bearing 6 and abutting at the other end against the journal portion 5*b*. The bearing 6 is prevented by the collar 9 from moving in an axial direction.

A slide shaft 14 abuts against one end (left) of the support shaft 13, the shaft 14 being journalled by the bearing fixed to the headrest carrier 3, and a stopper 15 is fixedly fitted by the screw 17 over the shaft 14. The end of the bearing 6 is brought into abutment against the stopper 15 to prevent the shaft 14 from axially being drawn out of place.

In the embodiment constructed above, when the slide shaft 14 is pushed in to the right side in the drawing against the action of the spring 10, the support 13 slides to the right with the offset diameter portion 13*a*-1 of support shaft 13 brought into axial engagement with the circumferential surface 8*e* on the axial hole side of the ratchet wheel 8, and the pawl teeth 8*a* are brought out of engagement with the pawl teeth 6*a* in accordance with such rightward slide. Accordingly, in this state, the rotary bearing 6 is made rotatable around the support shaft 3 (more particularly, the enlarged diameter portion 13*a*), with the result that the headrest is tiltable in either direction of tilting forward or backward. Accordingly, when the operator tilts the headrest in a desired direction and position by gripping the handle and then relieves the slide shaft 14 of pushing force, the ratchet wheel 8 is restored by righting force of the spring 10 to the original position to thereby bring the pawl teeth 8*a* into engagement with the pawl teeth 6*a*. By this engagement, the headrest 2 is locked substantially in the fixed position described above even if there is a certain discrepancy between the pitches of the teeth 8*a* and 6*a*, and the headrest is made unable to move either in the direction of downward tilting or in that of rearward tilting. In the above process of the ratchet wheel 8 returning to its original position, it will be understood that the shaft 14 is stopped by the stopper 15, the right end of the support shaft 13 by the nut 17 and the journal portion 5*b*, the bearing 6 by the journal portion 5*a*, and the ratchet wheel 8 is stopped by the tooth mating faces of the pawl teeth 8*a* and 6*a*, respectively in their original positions, and that the ratchet wheel 8 is prevented by the pin 11 from being circumferentially rotated.

In FIGS. 5 and 6 wherein another embodiment is shown, the support 13 is transferred from inside the headrest carrier 3 to the inside of a backrest carrier 16*b*. Accordingly, the support 7 of the headrest 2 is substantially exposed in this embodiment and a device for controlling forward and rearward tilting of the headrest is received inside the backrest carrier 1*b*. This type of structure, with the tilting control device excluded, is already described also in the prior art. Since the device for controlling headrest tilt in this embodiment is mechanically the same as that in the preceding embodiment, repetition of description of the device is omitted for brevity's sake, and the corresponding parts throughout the two embodiments are indicated by the same reference characters.

In this embodiment, what is to be pointed out as a minor modification in design is that the support base 5 is fixed to the back of the backrest 1, that the slide shaft 14 comprises a knob 14' exposed on the upper end face of the backrest 1 and a web 14'' moving horizontally in cooperation with the knob 14', that the lower end of the support 7 and the rotary bearing 6 are connected intermediately by an inverted bowlshaped connection piece 18, and otherwise. It is needless to mention that the tilting control device in this embodiment operates the same and has the same effect as that in the preceding embodiment.

As apparent from the above description, this invention makes it possible for the headrest to tilt back and forth merely by the support shaft being pushed in only in one direction and to stop in the desired position by releasing the support shaft from its pushing force. Thus, the tilt control device of this invention is not only very simple to operate but also makes it possible to design the tooth pitch in fine spacing by the employment of radial trapezoidal pawl teeth to thereby permit fine positioning. These are effects of practical use which can untangle the problems inherent in the prior art.

We claim:

1. In a treatment table designed to tilt a headrest back and forth upwardly of a backrest and to freely stop said headrest by means of a device for controlling tilting of said headrest, said device comprises a rotary bearing connected to a support of said headrest and equipped on one side end face with radial trapezoidal pawl teeth, a support shaft rotatably carrying said bearing and allowed to axially move, a ratchet wheel having on a side end face another pawl teeth capable of meshing with said pawl teeth and carried by said support shaft and prevented from rotating circumferentially but allowed to axially move, a spring means for normally elastically biasing said ratchet wheel in one direction and bringing said pawl teeth and said another pawl teeth into meshing engagement with each other, and a slide shaft in the direction of the shaft acting against the action of said spring means and to bring said pawl teeth and said another pawl teeth out of meshing engagement with each other, whereby the headrest can be securely locked at any tilt angle and said headrest is preventing from tilting back or forth upwardly when said headrest is locked at said tilt angle.

2. A device according to claim 1 wherein the support of said headrest is transversely incorporated into a lower part of a headrest base.

3. A device according to claim 1 wherein the support of said headrest is transversely incorporated into an upper part of a backrest base.

4. A device according to claim 1 further comprising a cylindrical collar which is sleeved over an outer periphery of said ratchet wheel, said collar further enclosing said spring means therein and covering said trapezoidal pawl teeth of said rotary bearing and said ratchet wheel.

* * * * *